US005525167A

United States Patent [19]

McVicker

[11] Patent Number: 5,525,167

[45] Date of Patent: Jun. 11, 1996

[54] ELEVATED NITROGEN HIGH TOUGHNESS STEEL ARTICLE

[75] Inventor: Joseph E. McVicker, Chillicothe, Ill.

[73] Assignee: Caterpillar Inc., Peoria, Ill.

[21] Appl. No.: 385,410

[22] Filed: Feb. 8, 1995

Related U.S. Application Data

[63] Continuation-in-part of Ser. No. 267,996, Jun. 28, 1994.

[51] Int. Cl.[6] ..... C22C 38/46; C22C 38/44

[52] U.S. Cl. ..... 148/335; 420/109

[58] Field of Search ..... 420/109, 110, 420/126, 128; 148/335

[56] References Cited

U.S. PATENT DOCUMENTS 3,664,830 5/1972 Kambayashi et al. ..... 420/110
5,131,965 7/1992 McVicker .

FOREIGN PATENT DOCUMENTS 60-114552 6/1985 Japan ..... 420/105

*Primary Examiner*—Deborah Yee
*Attorney, Agent, or Firm*—Pankaj M. Khosla; Kenneth A. Rhoads

[57] ABSTRACT

A high toughness steel has a composition comprising, by weight, about 0.10% to 1.05% carbon, about 0.00% to 0.05% aluminum, about 0.01% to 0.20% titanium, about 0.0005% to 0.02% boron, about 0.01% to 0.20% niobium and about 0.015% to 0.04% nitrogen and the balance essentially iron. Also, the composition contains sufficient amount of manganese, silicon, nickel, chromium, vanadium, and molybdenum such that said high toughness steel article, after quenching and tempering, has a $R_c$ hardness measured in the middle of a section having a thickness of no more than 25.4 mm, of at least 50% of the hardness measured at the surface of said section. After quenching and tempering, steel articles made of this composition have a plane strain fracture toughness more than 25% higher than that for steel having the same base chemistry and heat treatment, and being free from titanium, niobium, and boron and elevated nitrogen. Also, the composition preferably contains about 0.001% to 0.004% oxygen and less than about 0.04% each of phosphorous and sulfur.

A high toughness steel embodying the present invention is particularly useful for making ground engaging tools that are constantly subjected to severe impact and vibration and are susceptible to breakage.

10 Claims, 2 Drawing Sheets

ELEVATED NITROGEN HIGH TOUGHNESS STEEL ARTICLE

This is a Continuation-in-Part of application Ser. No. 08/267,996, filed Jun. 28, 1994.

TECHNICAL FIELD

The present invention relates to a high toughness steel, and more particularly to a high toughness steel having excellent fracture resistance and good hardness, hardenability and grain size.

BACKGROUND ART

Ground engaging tools, such as bucket teeth of an excavator or a back hoe, ripper tips, and cutting edges of construction equipment that operate on gravel, sand and soil, require the tool to be able to withstand fracture, abrasion and wear. In order to have a good wear resistance, the tool must have high hardness and hardenability without being too brittle. In order to resist fracture, the tool must have high fracture toughness. In certain applications, such as mines or gravel pits, where the ground engaging tools are constantly impacted against rocks and gravel, the tools break more often because they do not possess the requisite high fracture toughness. In such applications, although good hardenability and high hardness are desirable, and more so for larger parts, they are however, not of as paramount an importance as fracture toughness. A number of attempts have been made heretofore, to provide a steel material that has extremely high fracture toughness.

In the past, other inventors have proposed a number of steel compositions having varying degrees of wear resistance and toughness. Most of these steel compositions include relatively large amounts, i.e. above 2%, of alloying elements such as chromium, nickel, molybdenum and silicon to improve the hardenability. For example, U.S. Pat. No. 3,973,951 issued Aug. 10, 1976 to K. Satsumabayashi et al., discloses a steel composition intended primarily for use as an excavating tool edge and having a chromium content of 3% to 6%. U.S. Pat. No. 4,170,497 issued Oct. 9, 1979 to G. Thomas et al., discloses a steel composition that preferably includes 3% to 4.5% chromium and is intended for use in mining buckets and other mineral processing operations. The steel composition embodying the present invention has excellent fracture toughness and good hardness, but it does not require alloying elements, such as chromium, to achieve high toughness. In fact, the steel composition embodying the present invention contains no more than 1.60% chromium, and preferably about 0.1% chromium. However, chromium may be added as a cost effective way to enhance the hardenability.

Other steels intended for use in applications requiring a combination of very high toughness and good hardenability require significant amounts of nickel. It is generally recognized that nickel imparts toughness and hardenability to steel because it does not form any carbides but remains in solution in the ferrite, thereby toughening the ferrite. U.S. Pat. No. 2,791,500 issued May 7, 1957 to F. Foley et al., U.S. Pat. No. 3,165,402 issued Jan. 12, 1965 to W. Finkl, and U.S. Pat. No. 3,379,582 issued Apr. 23, 1968 to H. Dickinson all disclose steel compositions having significantly large amounts of nickel. It has been discovered in the present invention that large amounts, i.e., above 150 ppm, of nitrogen can be used to achieve high fracture toughness in steels having very low amounts, i.e., below 0.1% of nickel. It has been further discovered that if nitrogen is present in such large amounts in balance with controlled amounts of certain other elements, particularly titanium, boron and niobium, the fracture toughness of the steel is remarkably enhanced. Thus, the steel composition embodying the present invention has excellent fracture toughness and good hardness, but it does not require nickel to achieve high toughness. In fact, the steel composition embodying the present invention contains no more than about 0.05% nickel. However, nickel may be added to enhance the hardenability.

It has been suggested by other inventors that the solubility of nitrogen in steel may be increased by increasing the amount of chromium in the steel. U.S. Pat. No. 5,232,660 issued Aug. 3, 1993 to Finkl et al. discloses a steel composition intended mainly for use in closed die drop forging die sets wherein the emphasis is to increase the hardness of steel to improve the wear resistance of the die and also to increase the hardenability of steel to improve the dimensional quality of the parts produced over the useful life of the die. Finkl uses nitrogen, in amounts ranging from 100 to 400 parts per million (ppm), in low alloy steels to primarily improve their hardness, hardenability and wear resistant properties. However, Finkl uses a substantially larger amount of nickel (0.6 to 1.0%), in an effort to increase the toughness of the steel. In the present invention, it has been observed that increasing the amount of nitrogen from a conventional value of about 80–90 ppm to a value in the range of about 150 to 400 ppm, and adding calculated amounts of titanium, boron and niobium, actually increases the fracture toughness of the steel but, unlike the suggestion made by Finkl, the hardenability of steel is not enhanced.

U.S. Pat. No. 5,131,965 issued Jul. 21, 1992 to McVicker and assigned to the same company as this instant invention, discloses a steel having good hardenability and toughness. However, McVicker uses high amounts of chromium (1.5 to 2.5%) and silicon (1.0 to 3.0%) to attain strength, hardenability and temper resistance properties without exploiting the effect of enhanced nitrogen in conjunction with titanium, boron and niobium to get high fracture toughness, as done in the present invention.

It has further been suggested by other inventors that the inclusion of aluminum and titanium in steel increases the wear resistance by increasing the hardenability due to the formation of nitrides and carbo-nitrides. Both the Finkl patent and U.S. Pat. No. 4,765,849 issued Aug. 23, 1988 to W. Roberts teach the inclusion of aluminum and titanium in the steel composition. Although the inclusion of titanium is similar to that proposed by the present invention, Roberts adds substantially higher amounts of aluminum (0.4% to 1.0%) than that specified in the present invention, to intentionally form aluminum nitride in the solidified steel product. Furthermore, Finkl appears to suggest that aluminum nitride is required to impart good toughness in steel. Contrary to the teaching in the Finkl patent, it is generally recognized that the presence of aluminum nitride is undesirable in steel requiring high toughness. Finkl also suggests that increasing aluminum and titanium will increase the solubility of nitrogen. The opposite of this is generally recognized i.e., although increasing the aluminum and titanium will increase the total nitrogen content in the steel, the nitrogen is tied up as precipitates and not as soluble nitrogen.

It is desirable to have an extremely high fracture toughness steel by exploiting the effect of nitrogen in conjunction with titanium, boron and niobium. It is further desirable that the steel composition be such that the high fracture toughness is always maintained independent of the hardenability and hardness, i.e., the chemistry that effects hardenability and hardness should be transparent to the base chemistry that yields high fracture toughness. The present invention is directed to overcome one or more of the problems as set forth above.

DISCLOSURE OF THE INVENTION

In one aspect of the invention, a high toughness steel article has a composition comprising, by weight percent, from 0.10 to 1.05 carbon, from 0.00 to 0.05 aluminum, from 0.01 to 0.20 titanium, from 0.0005 to 0.02 boron, from 0.01 to 0.20 niobium, from 0.015 to 0.04 nitrogen, from 0.001 to 0.004 oxygen, less than 0.04 phosphorous, and less than 0.04 sulfur.

The Steel further comprises, manganese, silicon, nickel, chromium, vanadium, and molybdenum in a weight percent such that said high toughness steel article, after quenching and tempering, has a $R_c$ hardness measured in the middle of a section having a thickness of no more than 25.4 mm (1 in), of at least 50% of the hardness measured at the surface of the section. The balance of the steel is essentially iron.

The steel article has only trace amounts of aluminum nitride, and after quenching and tempering, has a plain strain fracture toughness more than 25% higher than that for steel having the same base chemistry and heat treatment, and being free from titanium, niobium, and boron and elevated nitrogen.

In another aspect of the invention, a high toughness steel article has a composition comprising, by weight percent from 0.10 to 1.05 carbon, from 0.00 to 0.05 aluminum, from 0.01 to 0.20 titanium, from 0.0005 to 0.02 boron, from 0.01 to 0.20 niobium, from 0.015 to 0.04 nitrogen, from 0.001 to 0.004 oxygen, less than 0.025 phosphorous, less than 0.025 sulfur, from 0.30 to 1.75 manganese, from 0.10 to 1.45 silicon, from 0.0 to 3.50 nickel, no more than 0.25 vanadium, from 0.00 to 1.60 chromium, from 0.0 to 0.75 molybdenum, and the balance essentially iron.

The steel article, after quenching and tempering, has a $R_c$ hardness measured in the middle of a section having a thickness of no more than 25.4 mm (1 in), of at least 50% of the hardness measured at the surface of the section.

The steel article further has only trace amounts of aluminum nitride and after quenching and tempering, further having a plane strain fracture toughness more than 25% higher than that for steel having the same base chemistry and heat treatment, and being free from titanium, niobium, and boron and elevated nitrogen.

BEST MODE FOR CARRYING OUT THE INVENTION

Figure 1:
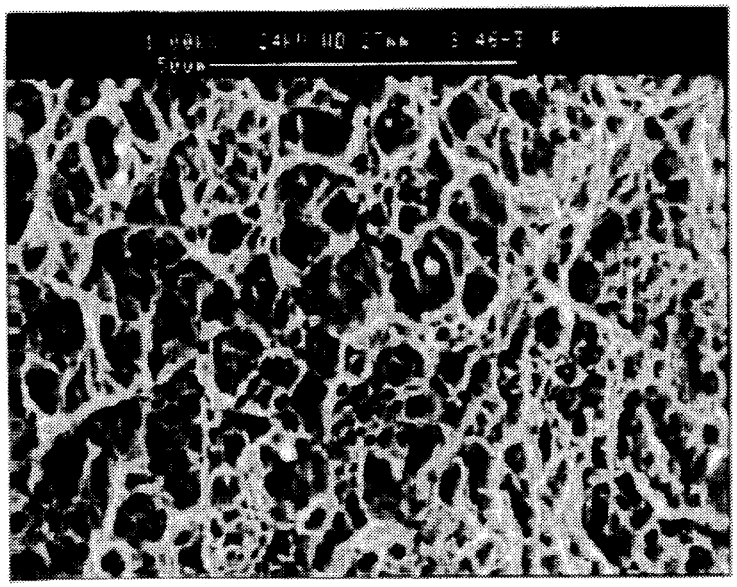
FIG. 1 is a scanning electron microscope (SEM) photograph of a typical fracture surface of elevated nitrogen high toughness steel sample 1 according to the present invention.

In one aspect of the present invention, a high fracture toughness steel has a composition comprising, by weight percent:

| | |
|---|---|
| carbon | 0.20 to 1.00 |
| aluminum | 0.00 to 0.035 |
| titanium | 0.015 to 0.15 |
| boron | 0.001 to 0.01 |
| niobium | 0.03 to 0.15 |
| vanadium | less than 0.15 |
| nitrogen | 0.015 to 0.03 |
| oxygen | 0.00125 to 0.00375 |
| phosphorus | less than 0.02 |
| sulfur | less than 0.02 |
| manganese | 0.50 to 1.20 |
| silicon | 0.15 to 1.25 |
| nickel | 0.00 to 3.00 |
| chromium | 0.00 to 1.40 |
| molybdenum | 0.00 to 0.65 |
| iron | balance. |

The manganese, silicon, nickel, chromium and molybdenum is in a weight percent such that the high toughness steel article, after quenching and tempering, has a $R_c$ hardness measured in the middle of a section having a thickness of no more than 25.4 mm (1 in), of at least 50% of the hardness measured at the surface of the section.

In another aspect of the present invention, a high fracture toughness steel has a composition comprising, by weight percent:

| | |
|---|---|
| carbon | 0.10 to 1.05 |
| aluminum | 0.00 to 0.05 |
| titanium | 0.01 to 0.20 |
| boron | 0.0005 to 0.02 |
| niobium | 0.01 to 0.20 |
| vanadium | less than 0.25 |
| nitrogen | 0.015 to 0.04 |
| oxygen | 0.001 to 0.004 |
| phosphorus | less than 0.025 |
| sulfur | less than 0.025 |
| manganese | 0.30 to 1.75 |
| silicon | 0.10 to 1.45 |
| nickel | 0.00 to 3.50 |
| chromium | 0.00 to 1.60 |
| molybdenum | 0.00 to 0.75 |
| iron | balance. |

The steel article, after quenching and tempering, having a $R_c$ hardness measured in the middle of a section having a thickness of no more than 25.4 mm (1 in), of at least 50% of the hardness measured at the surface of the section. The steel article further having only trace amounts of aluminum nitride.

The steel article, after quenching and tempering, further having a plane strain fracture toughness more than 25% higher than that for steel having the same base chemistry and heat treatment, and being free from titanium, niobium, and boron and elevated nitrogen.

In the preferred embodiment of the present invention, a high fracture toughness steel has a composition comprising, by weight percent:

| | |
|---|---|
| carbon | 0.10 to 1.05 |
| aluminum | 0.00 to 0.05 |
| titanium | 0.01 to 0.20 |
| boron | 0.0005 to 0.02 |
| niobium | 0.01 to 0.20 |
| nitrogen | 0.015 to 0.04 |
| oxygen | 0.001 to 0.004 |
| phosphorus | less than 0.04 |
| sulfur | less than 0.04 |

The steel has manganese, silicon, nickel, chromium, vanadium, and molybdenum in a weight percent such that the high toughness steel article, after quenching and tempering, has a $R_c$ hardness measured in the middle of a section having a thickness of no more than 25.4 mm (1 in), of at least 50% of the hardness measured at the surface of said section. The balance of the steel is essentially iron.

The steel article has only trace amounts of aluminum nitride. After quenching and tempering, the steel article has a plain strain fracture toughness more than 25% higher than that for steel having the same base chemistry and heat treatment and being free from titanium, niobium, and boron and elevated nitrogen.

The high toughness steel of the present invention has about twice the amount of nitrogen as is typical in conventional electric furnace steels. In order for nitrogen to enhance the fracture toughness of the steel, nitrogen is maintained in the steel, even though very low amounts of nickel and chromium may be used, by carefully balancing the amounts of and the order of addition of titanium, boron and niobium in relation to the addition of nitrogen and aluminum. The high toughness steel of the present invention requires no chromium, nickel, vanadium, or molybdenum and is essentially free of copper. However it should be understood that the above described steel composition may contain a small quantity of copper which is not required and is considered as incidental. In particular, up to 0.35% copper may be present as residual elements in accepted commercial practice. While not required to obtain enhanced fracture toughness, silicon, nickel, chromium, vanadium, and molybdenum may be included to enhance hardenability.

The term "high toughness steel", as used herein means a steel having properties such as fine grain size and uniform grain structure resulting in high fracture toughness, that permit a component made thereof to have a high resistance to failure by brittle fracture.

The term "hardenability", as used herein means a steel having properties that permit a component made thereof to be hardened throughout its cross-section or as nearly throughout as possible.

The term "quenching" and "tempering", as used herein means a heat treatment which achieves a fully quenched microstructure.

For the steel material in illustrative Examples A–H described below, the steel ingots were made in the following manner: each sample was vacuum induction melted and poured into a 50 lb. ingot mold. The ingots were reheated to 1232° C. (2250° F.) and rolled to square bars having a cross-section area of about 2.89 square inches. Heat treatment of steel samples obtained from illustrative Examples A–H specifically includes the following steps:

1. Through heating the test sample to the austenitizing temperature of the steel to produce a homogeneous solution throughout the section without harmful decarburization, grain growth, or excessive distortion. In the following illustrative Examples A, B, D, E, and G the articles were heated to 870° C. (1598° F.) for about one hour. In illustrative Examples C, F, and H, the articles were heated to 860° C. (1580° F.) for about one hour.

2. Fully quenched in water to produce the greatest possible depth of hardness.

3. Tempered by reheating for a sufficient length of time to permit temperature equalization of all sections. In the illustrative Examples described below, the articles were heated to about 200° C. (392° F.) for about one hour.

As shown by the following examples, the steel material embodying the present invention has significantly higher fracture toughness properties when compared with prior art steel materials having similar base chemistry and hardenability.

Example A

An experimental ingot representative of a prior art 41xx series steel having 0.30 carbon was melted, poured, and rolled to about 5:1 reduction to form a 43 mm (1.7 in) square bar. After rolling, the bar was found, by spectrographic methods, to have the following composition:

| | |
|---|---|
| carbon | 0.300 |
| manganese | 0.850 |
| phosphorus | 0.014 |
| sulfur | 0.005 |
| silicon | 0.210 |
| nickel | 0.100 |
| chromium | 0.940 |
| molybdenum | 0.180 |
| aluminum | 0.019 |
| nitrogen | 0.012 |
| oxygen | 0.003 |
| iron | essentially balance |

After rolling, three 25.4 mm (1 in) diameter short rod fracture toughness test specimens were machined from the bar in accordance with ASTM test method E 1304 having L-T orientation as described in ASTM test method E 399. The fracture toughness test specimens were heat treated according to the above defined quench and temper operation to obtain a fully martensitic microstructure, tested in accordance with ASTM test method E 1304, and found to have the following properties:

| | |
|---|---|
| Hardness (Rc) | 47 |
| Fracture Toughness (MPa $\sqrt{m}$) | 75 |
| (ksi $\sqrt{in}$) | 68 |

Hardness measurements were made on each of the fracture toughness test specimens at a point about 12.7 mm (0.5 in) below the grip slot face end. The reported fracture toughness value is the average value of the three short rod specimens tested.

Fracture surfaces from the fracture surfaces of short rod fracture toughness specimens were examined by scanning electron microscope techniques. Fracture surfaces showed a mixture of brittle facets and ductile dimples.

Example B

An experimental ingot representative of a prior art 50xx series steel having 0.30 carbon was melted, poured, and rolled to about 5:1 reduction to form a 43 mm (1.7 in) square bar. After rolling, the bar was found, by spectrographic methods, to have the following composition:

| | |
|---|---|
| carbon | 0.310 |
| manganese | 0.820 |
| phosphorus | 0.009 |
| sulfur | 0.005 |
| silicon | 0.200 |
| nickel | 0.030 |
| chromium | 0.900 |
| molybdenum | 0.030 |
| aluminum | 0.045 |

-continued

| | |
|---|---|
| nitrogen | 0.009 |
| oxygen | 0.002 |
| iron | essentially balance |

After rolling, three 25.4 mm (1 in) diameter short rod fracture toughness test specimens were machined from the bar in accordance with ASTM test method E 1304 having L-T orientation as described in ASTM test method E 399. The fracture toughness test specimens were heat treated according to the above defined quench and temper operation to obtain a fully martensitic microstructure, tested in accordance with ASTM test method E 1304, and found to have the following properties:

| | |
|---|---|
| Hardness (Rc) | 50 |
| Fracture Toughness (MPa $\sqrt{m}$) | 73 |
| (ksi $\sqrt{in}$) | 66 |

Hardness measurements were made on each of the fracture toughness test specimens at a point about 12.7 mm (0.5 in) below the grip slot face end. The reported fracture toughness value is the average value of the three short rod specimens tested.

Fracture surfaces from the fracture surfaces of short rod fracture toughness specimens were examined by scanning electron microscope techniques. Fracture surfaces showed a mixture of brittle facets and ductile dimples.

Example C

An experimental ingot representative of a prior art 41xx series steel having 0.40 carbon was melted, poured, and rolled to about 5:1 reduction to form a 43 mm (1.7 in) square bar. After rolling, the bar was found, by spectrographic methods, to have the following composition:

| | |
|---|---|
| carbon | 0.410 |
| manganese | 0.850 |
| phosphorus | 0.014 |
| sulfur | 0.005 |
| silicon | 0.210 |
| nickel | 0.100 |
| chromium | 0.940 |
| molybdenum | 0.180 |
| aluminum | 0.020 |
| nitrogen | 0.013 |
| oxygen | 0.002 |
| iron | essentially balance |

After rolling, three 25.4 mm (1 in) diameter short rod fracture toughness test specimens were machined from the bar in accordance with ASTM test method E 1304 having L-T orientation as described in ASTM test method E 399. The fracture toughness test specimens were heat treated according to the above defined quench and temper operation to obtain a fully martensitic microstructure, tested in accordance with ASTM test method E 1304, and found to have the following properties:

| | |
|---|---|
| Hardness (Rc) | 54 |
| Fracture Toughness (MPa $\sqrt{m}$) | 52 |

-continued

| | |
|---|---|
| (ksi $\sqrt{in}$) | 47 |

Hardness measurements were made on each of the fracture toughness test specimens at a point about 12.7 mm (0.5 in) below the grip slot face end. The reported fracture toughness value is the average value of the three short rod specimens tested.

Fracture surfaces from the fracture surfaces of short rod fracture toughness specimens were examined by scanning electron microscope techniques. Fracture surfaces showed a mixture of brittle facets and ductile dimples.

Example D

Importantly, in the preparation of the melt for Example D, the order of addition of aluminum, titanium, niobium, and boron was precisely maintained. Aluminum was added to the ladle first to deplete the oxygen. Titanium, niobium, and boron were added in the ladle after the aluminum addition. This order of addition is essential, in combination with elevated nitrogen and control of the composition, in preventing the formation of undesirable aluminum nitride in the solidified steel. Titanium and boron have a stronger affinity for nitrogen than aluminum, and niobium has a slightly lower affinity for nitrogen than aluminum. Therefore, the controlled addition of relatively small amounts of titanium, niobium, and boron preferentially combine with nitrogen and carbon in the steel, forming titanium nitrides, titanium carbo-nitrides, niobium nitrides, niobium carbo-nitrides, boron nitrides, and boron carbides. With the nitrogen thus combined with titanium and boron, there is no free nitrogen available to combine with aluminum. Further, since aluminum has a higher affinity for oxygen than titanium, niobium, or boron, the earlier (or concurrent) addition of the aluminum protects titanium, niobium, and boron from oxidation, thereby enabling the titanium, niobium, and boron to combine with available excess nitrogen. Thus, in the present invention, the formation of undesirable aluminum nitrides is prevented or limited to trace amounts, and the formation of desirable titanium nitrides, titanium carbo-nitrides, niobium nitrides, niobium carbo-nitrides, boron nitrides, and boron carbides is promoted. These desirable nitrides, carbonitrides, and carbides significantly contribute to the improved fracture toughness properties of the high toughness material.

An experimental ingot representative of a prior art 41xx series steel having 0.30 carbon was melted, poured, and rolled to about 5:1 reduction to from a 43 mm (1.7 in) square bar. After rolling, the bar was found, by spectrographic methods, to have the following composition:

| | |
|---|---|
| carbon | 0.290 |
| manganese | 0.860 |
| phosphorus | 0.013 |
| sulfur | 0.005 |
| silicon | 0.200 |
| nickel | 0.100 |
| chromium | 0.920 |
| molybdenum | 0.180 |
| aluminum | 0.020 |
| titanium | 0.039 |
| niobium | 0.071 |
| boron | 0.002 |
| nitrogen | 0.021 |
| oxygen | 0.002 |

-continued

| | |
|---|---|
| iron | essentially balance |

After rolling, three 25.4 mm (1 in) diameter short rod fracture toughness test specimens were machined from the bar in accordance with ASTM test method E 1304 having L-T orientation as described in ASTM test method E 399. The fracture toughness test specimens were heat treated according to the above defined quench and temper operation to obtain a fully martensitic microstructure, tested in accordance with ASTM test method E 1304, and found to have the following properties:

| | |
|---|---|
| Hardness (Rc) | 48 |
| Fracture Toughness (MPa $\sqrt{m}$) | 117 |
| (ksi $\sqrt{in}$) | 106 |

Hardness measurements were made on each of the fracture toughness test specimens at a point about 12.7 mm (0.5 in) below the trip slot face end. The reported fracture toughness value is the average value of the three short rod specimens tested.

Fracture surfaces from the fracture surfaces of short rod fracture toughness specimens were examined by scanning electron microscope techniques. Fracture surfaces showed predominately ductile dimples.

Example E

Importantly, in the preparation of the melt for Example E the order of addition of aluminum, titanium, niobium, and boron was precisely maintained. Aluminum was added to the ladle first to deplete the oxygen. Titanium, niobium, and boron were added in the ladle after the aluminum addition. This order of addition is essential, in combination with elevated nitrogen and control of the composition, in preventing the formation of undesirable aluminum nitride in the solidified steel. Titanium and boron have a stronger affinity for nitrogen than aluminum, and niobium has a slightly lower affinity for nitrogen than aluminum. Therefore, the controlled addition of relatively small amounts of titanium, niobium, and boron preferentially combine with nitrogen and carbon in the steel, forming titanium nitrides, titanium carbo-nitrides, niobium nitrides, niobium carbo-nitrides, boron nitrides, and boron carbides. With the nitrogen thus combined with titanium and boron, there is no free nitrogen available to combine with aluminum. Further, since aluminum has a higher affinity for oxygen than titanium, niobium, or boron, the earlier (or concurrent) addition of the aluminum protects titanium, niobium, and boron from oxidation, thereby enabling the titanium, niobium, and boron to combine with available excess nitrogen. Thus, in the present invention, the formation of undesirable aluminum nitrides is prevented or limited to trace amounts, and the formation of desirable titanium nitrides, titanium carbo-nitrides, niobium nitrides, niobium carbo-nitrides, boron nitrides, and boron carbides is promoted. These desirable nitrides, carbonitrides and carbides significantly contribute to the improved fracture toughness properties of the high toughness material.

An experimental ingot representative of a prior art 41xx series steel having 0.30 carbon was melted, poured, and rolled to about 5:1 reduction to from a 43 mm (1.7 in) square bar. After rolling, the bar was found, by spectrographic methods, to have the following composition:

| | |
|---|---|
| carbon | 0.310 |
| manganese | 0.990 |
| phosphorus | 0.015 |
| sulfur | 0.006 |
| silicon | 0.210 |
| nickel | 0.040 |
| chromium | 0.800 |
| molybdenum | 0.040 |
| aluminum | 0.021 |
| titanium | 0.035 |
| niobium | 0.080 |
| boron | 0.007 |
| nitrogen | 0.020 |
| oxygen | 0.004 |
| iron | essentially balance |

After rolling, three 25.4 mm (1 in) diameter short rod fracture toughness test specimens were machined from the bar in accordance with ASTM test method E 1304 having L-T orientation as described in ASTM test method E 399. The fracture toughness test specimens were heat treated according to the above defined quench and temper operation to obtain a fully martensitic microstructure, tested in accordance with ASTM test method E 1304, and found to have the following properties:

| | |
|---|---|
| Hardness (Rc) | 50 |
| Fracture Toughness (MPa $\sqrt{m}$) | 111 |
| (ksi $\sqrt{in}$) | 101 |

Hardness measurements were made on each of the fracture toughness test specimens at a point about 12.7 mm (0.5 in) below the grip slot face end. The reported fracture toughness value is the average value of the three short rod specimens tested.

Fracture surfaces from the fracture surfaces of short rod fracture toughness specimens were examined by scanning electron microscope techniques. Fracture surfaces showed predominately ductile dimples.

Example F

Importantly, in the preparation of the melt for Example F the order of addition of aluminum, titanium, niobium, and boron were precisely maintained. Aluminum was added to the ladle first to deplete the oxygen. Titanium, niobium, and boron were added in the ladle after the aluminum addition. This order of addition is essential, in combination with elevated nitrogen and control of the composition, in preventing the formation of undesirable aluminum nitride in the solidified steel. Titanium and boron have a stronger affinity for nitrogen than aluminum, and niobium has a slightly lower affinity for nitrogen than aluminum. Therefore, the controlled addition of relatively small amounts of titanium, niobium, and boron preferentially combine with nitrogen and carbon in the steel, forming titanium nitrides, titanium carbo-nitrides, niobium nitrides, niobium carbo-nitrides, boron nitrides, and boron carbides. With the nitrogen thus combined with titanium and boron, there is no free nitrogen available to combine with aluminum. Further, since aluminum has a higher affinity for oxygen than titanium, niobium, or boron, the earlier (or concurrent) addition of the aluminum protects titanium, niobium, and boron from oxidation, thereby enabling the titanium, niobium, and boron to combine with available excess nitrogen. Thus, in the present invention, the formation of undesirable aluminum nitrides is prevented or limited to trace amounts, and the formation of desirable titanium nitrides, titanium carbo-nitrides, niobium nitrides, niobium carbo-nitrides, boron nitrides, and boron carbides is promoted. These desirable nitrides, carbonitrides, and carbides significantly contribute to the improved fracture toughness properties of the high toughness material.

An experimental ingot representative of a prior art 41xx series steel having 0.30 carbon was melted, poured, and rolled to about 5:1 reduction to form a 43 mm (1.7 in) square bar. After rolling, the bar was found, by spectrographic methods, to have the following composition:

| | |
|---|---|
| carbon | 0.390 |
| manganese | 0.860 |
| phosphorus | 0.014 |
| sulfur | 0.005 |
| silicon | 0.200 |
| nickel | 0.100 |
| chromium | 0.930 |
| molybdenum | 0.180 |
| aluminum | 0.020 |
| titanium | 0.039 |
| niobium | 0.079 |
| boron | 0.006 |
| nitrogen | 0.020 |
| oxygen | 0.002 |
| iron | essentially balance |

After rolling, three 25.4 mm (1 in) diameter short rod fracture toughness test specimens were machined from the bar in accordance with ASTM test method E 1304 having L-T orientation as described in ASTM test method E 399. The fracture toughness test specimens were heat treated according to the above defined quench and temper operation to obtain a fully martensitic microstructure, tested in accordance with ASTM test method E 1304, and found to have the following properties:

| | |
|---|---|
| Hardness (Rc) | 54 |
| Fracture Toughness (MPa $\sqrt{m}$) | 71 |
| (ksi $\sqrt{in}$) | 65 |

Hardness measurements were made on each of the fracture toughness test specimens at a point about 12.7 mm (0.5 in) below the grip slot face end. The reported fracture toughness value is the average value of the three short rod specimens tested.

Fracture surfaces from the fracture surfaces of short rod fracture toughness specimens were examined by scanning electron microscope techniques. Fracture surfaces showed predominately ductile dimples.

Example G

An experimental ingot representative of a prior art 41xx series steel having 0.30 carbon and elevated nitrogen but no titanium, niobium, or boron was melted, poured, and rolled to about 5:1 reduction to form a 43 mm (1.7 in) square bar. After rolling, the bar was found, by spectrographic methods, to have the following composition:

| | |
|---|---|
| carbon | 0.290 |
| manganese | 0.870 |
| phosphorus | 0.014 |
| sulfur | 0.005 |
| silicon | 0.200 |
| nickel | 0.100 |
| chromium | 0.940 |
| molybdenum | 0.170 |
| aluminum | 0.018 |
| nitrogen | 0.020 |
| oxygen | 0.003 |
| iron | essentially balance |

After rolling, three 25.4 mm (1 in) diameter short rod fracture toughness test specimens were machined from the bar in accordance with ASTM test method E 1304 having L-T orientation as described in ASTM test method E 399. The fracture toughness test specimens were heat treated according to the above defined quench and temper operation to obtain a fully martensitic microstructure, tested in accordance with ASTM test method E 1304, and found to have the following properties:

| | |
|---|---|
| Hardness (Rc) | 47 |
| Fracture Toughness (MPa $\sqrt{m}$) | 79 |
| (ksi $\sqrt{in}$) | 72 |

Hardness measurements were made on each of the fracture toughness test specimens at a point about 12.7 mm (0.5 in) below the grip slot face end. The reported fracture toughness value is the average value of the three short rod specimens tested.

Fracture surfaces from the fracture surfaces of short rod fracture toughness specimens were examined by scanning electron microscope techniques. Fracture surfaces showed a mixture of brittle facets and ductile dimples.

Example H

An experimental ingot representative of a prior art 41xx series steel having 0.40 carbon and elevated nitrogen and being free from titanium, niobium and boron was melted, poured, and rolled to about 5:1 reduction to form a 43 mm (1.7 in) square bar. After rolling, the bar was found, by spectrographic methods, to have the following composition:

| | |
|---|---|
| carbon | 0.400 |
| manganese | 0.850 |
| phosphorus | 0.013 |
| sulfur | 0.005 |
| silicon | 0.200 |
| nickel | 0.100 |
| chromium | 0.910 |
| molybdenum | 0.180 |
| aluminum | 0.018 |
| nitrogen | 0.019 |
| oxygen | 0.002 |
| iron | essentially balance |

After rolling, three 25.4 mm (1 in) diameter short rod fracture toughness test specimens were machined from the bar in accordance with ASTM test method E 1304 having L-T orientation as described in ASTM test method E 399. The fracture toughness test specimens were heat treated according to the above defined quench and temper operation to obtain a fully martensitic microstructure, tested in accordance with ASTM test method E 1304, and found to have the following properties:

| | |
|---|---|
| Hardness (Rc) | 54 |
| Fracture Toughness (MPa $\sqrt{m}$) | 42 |
| (ksi $\sqrt{in}$) | 38 |

Hardness measurements were made on each of the fracture toughness test specimens at a point about 12.7 mm (0.5 in) below the grip slot face end. The reported fracture toughness value is the average value of the three short rod specimens tested.

Fracture surfaces from the fracture surfaces of short rod fracture toughness specimens were examined by scanning electron microscope techniques. Fracture surfaces showed a mixture of brittle facets and ductile dimples.

Figure 2:
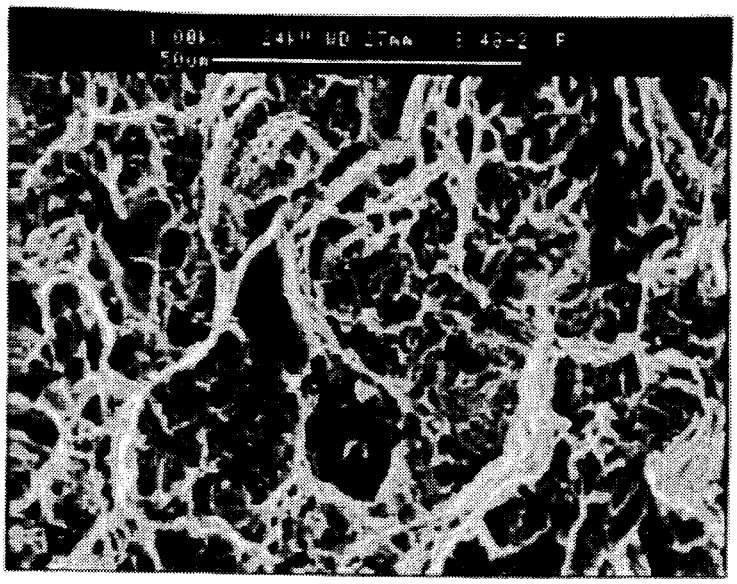
Fig 2 (PRIOR ART)
FIG. 2 is a scanning electron microscope (SEM) photograph of a typical fracture surface of prior art steel sample 2.

FIG. 1 shows the fracture surface of the high fracture toughness steel embodying the present invention (from Example D). The fracture surface is predominately fine ductile dimples which is consistent with the observed high fracture toughness. FIG. 2 shows the fracture surface of a prior art steel having the same base chemical composition (from Example A). The fracture surface shown in FIG. 2 shows a mixture of ductile dimples and brittle facets which is consistent with the lower observed fracture toughness.

Figure 3:
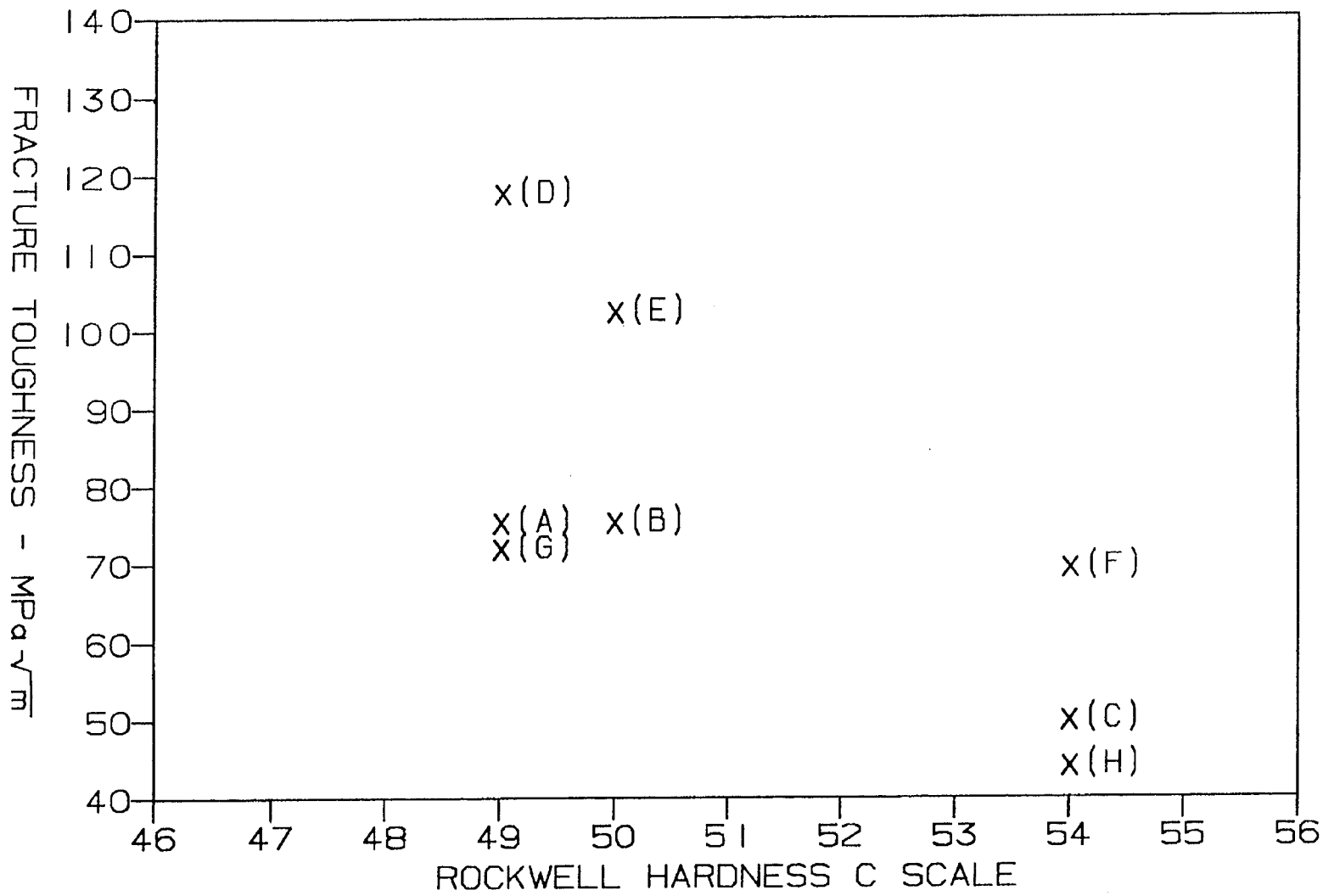
FIG. 3 is a graph showing the relationship between hardness and fracture toughness for the prior art steel and steel embodying the present invention.

The respective hardness and fracture toughness values of prior art steels described in Examples A, B, C, G and H and the high fracture toughness steels embodying the present invention described in Examples D, E, and F, are graphically shown in FIG. 3. The improvement is fracture toughness over the prior art material, in similar hardness ranges, is very apparent.

From FIG. 3 it is clear that the fracture toughness of steel having a given base chemistry is enhanced if the steel is treated with high nitrogen in the melt along with carefully controlled additions of titanium, niobium, and boron. It has been ascertained that when the boron addition is 0.002 or less, no boron hardenability intensification is observed, and base chemistry alloy additions of manganese, silicon, nickel, chromium, molybdenum, or vanadium used independently, or in combination, but be used to satisfy hardenability requirements. It has been discovered that the thermodynamic synergism between titanium, niobium, and boron, and their reactions with an elevated amount of nitrogen, contributes to the enhancement of fracture toughness.

It has been discovered in the present invention, as shown in illustrative Examples G and H, that an increased amount of nitrogen does not enhance the hardenability of the steel. Further, an increased amount of nitrogen, on its own, does not enhance fracture toughness either. Rather, it is the combination of elevated nitrogen, in thermodynamic balance with titanium, niobium, and boron, that enhances the fracture toughness of steel. A scanning electron microscope analysis of the fracture surfaces from Examples D, E, and F showed tiny (smaller than 1 micron) precipitates that are believed to be nitrides of titanium, niobium, and boron and also titanium and niobium carbo-nitrides formed by reaction of titanium, niobium, and boron with excess nitrogen. However, no aluminum nitride particles were observed.

To assure sufficient hardness and yet not adversely affect fracture toughness properties, carbon should be present, in the composition of the steel embodying the present invention, in a range of from about 0.10% to about 1.05% by weight, and preferably in the range of from about 0.20% to about 0.60%, by weight.

The steel composition embodying the present invention must have small, but essential, amounts of titanium, boron and niobium. Aluminum may be added in an amount sufficient to protect titanium, boron and niobium from oxidation. Furthermore, as described above in Examples D, E, and F, it is imperative that the addition of titanium, boron and niobium be made to the melt after (or concurrent with) the addition of aluminum to prevent the formation of undesirable aluminum nitrides. At least about 0.01% titanium, about 0.0005% boron and about 0.01% niobium are required to provide beneficial amounts of these elements. To avoid the undesirable interaction of these elements with oxygen, and preferably, to assure the desirable interaction of these elements with nitrogen, if aluminum is added, it should be limited to no more than 0.05%, and preferably less than about 0.025%, by weight. Titanium should be limited to no more than 0.2%, and preferably about 0.04%, by weight. Boron should be limited to no more than 0.02%, and preferably about 0.005%, by weight. Niobium should be limited to no more than 0.2%, and preferably about 0.08%, by weight.

To assure that there is sufficient nitrogen to combine with titanium, boron and niobium to form titanium nitrides, titanium carbo-nitrides, boron nitrides, niobium carbo-nitrides and niobium nitrides, it is extremely important that the steel composition have at least 0.015%, by weight, nitrogen. Preferably the nitrogen content should be between 0.017% and 0.027%, by weight, and even more preferably, about 0.02%, by weight.

The subject high toughness steel requires relatively small amounts of manganese and silicon, and no chromium, nickel, vanadium, or molybdenum. Manganese should be present in an amount of at least 0.30% by weight, and no more than 1.75%, and preferably no more than 1.0% by weight, to prevent the formation of iron sulfides and also enhance hardenability. Silicon should be present in amount of at least 0.10% by weight, and no more than 1.45%, and preferably no more than 0.20% by weight, to impart a deoxidizing effect. Although chromium, nickel and molybdenum are not necessary to impart fracture toughness, they may be used as a cost effective alternative to enhance the hardenability of the steel. If chromium is added, it should not exceed 1.60% by weight, and preferably be in the range of about 0.5% to 1.0% by weight. If nickel is added, it should not exceed 3.5% by weight, and preferably be in the range of about 0.06% to 0.1% by weight. If vanadium is added, it should not exceed 0.25% by weight, and preferably be in the range of 0.05% to 0.15% by weight. If molybdenum is added, it should not exceed 0.75% by weight, and preferably be in the range of 0.17% to 0.20% by weight.

Also, it is desirable that normal electric furnace steelmaking levels of oxygen, i.e., about 0.002% to 0.003%, be attained.

It is also desirable that the steel embodying the present invention contain no more than 0.04%, by weight, phosphorus and sulfur to assure that these elements do not adversely affect the fracture toughness properties of steel. Preferably, the composition contains no more than 0.015% sulfur and no more than 0.018% phosphorus.

In summary, the above illustrative Examples demonstrate that a significant increase in the fracture toughness of a high toughness steel can be achieved by the controlled addition of relatively small, but essential, amounts of titanium, boron and niobium in balance with elevated amounts of nitrogen. It has also been shown that fracture toughness is influenced substantially by the presence of niobium in conjunction with titanium and boron at elevated nitrogen levels. Further, it has been shown that the fracture toughness property does not depend on the addition of large amounts of alloying elements such as manganese, silicon, nickel, chromium, vanadium, and molybdenum. These alloying elements may be used to affect the hardenability as desired, in appropriate amounts, by those skilled in the art.

Industrial Applicability

The high toughness steel of the present invention is particularly useful in applications requiring tools that are subjected to severe impact and are thereby subject to brittle fracture and breakage. Examples of such tools include ground engaging implements used in construction, such as ripper tips, bucket teeth and cutting edges. However, this high toughness steel may also be used to make other articles such as shafts and gears.

Further, the high toughness steel described herein is economical to produce and does not require relatively high amounts, i.e., 3% or more, of chromium, nickel, manganese, silicon or molybdenum to achieve the high fracture toughness. Further, the high toughness steel article embodying the present invention responds to conventional quenching and tempering operations.

Other aspects, features and advantages of the present invention can be attained from a study of this disclosure together with the appended claims.

We claim:

1. A high toughness steel article having a composition comprising, by weight percent:

from 0.10 to 1.05 carbon, from 0.00 to 0.05 aluminum, from 0.01 to 0.20 titanium, from 0.0005 to 0.02 boron, from 0.01 to 0.20 niobium, from 0.015 to 0.04 nitrogen, from 0.001 to 0.004 oxygen, less than 0.04 phosphorous, less than 0.04 sulfur;

effective amounts of manganese, silicon, nickel, chromium, vanadium, and molybdenum in a weight percent, to obtain a $R_c$ hardness, of at least 47, after said article having been quenched and tempered, said $R_c$ hardness being measured in the middle of a section having a thickness of no more than 25.4 mm (1 in), of at least 50% of the hardness measured at the surface of said section;

the balance essentially iron;

said steel article having only trace amounts of aluminum nitride; and said steel article, after having been quenched and tempered, having a plain strain fracture toughness more than 25% higher than that for steel having the same base chemistry and heat treatment, and being free from titanium, niobium, and boron and elevated nitrogen.

2. A high toughness steel article, as set forth in claim 1, wherein said steel article, after having been quenched and tempered, has a $R_c$ hardness measured in the middle of a section having a thickness of no more than 25.4 mm (1 in), of at least 75% of the hardness measured at the surface of said section.

3. A high toughness steel article, as set forth in claim 1, wherein said steel article, after having been quenched and tempered, has a $R_c$ hardness measured in the middle of a section having a thickness of no more than 25.4 mm (1 in), of at least 90% of the hardness measured at the surface of said section.

4. A high toughness steel article, as set forth in claim 1, wherein said composition comprises, by weight percent:

from 0.2 to 1.00 carbon, from 0.00 to 0.035 aluminum, from 0.015 to 0.15 titanium, from 0.001 to 0.01 boron, from 0.03 to 0.15 niobium, less than 0.15 vanadium, from 0.015 to 0.03 nitrogen, from 0.00125 to 0.00375 oxygen, less than 0.02 phosphorous, less than 0.02 sulfur;

effective amounts of manganese, silicon, nickel, chromium, vanadium, and molybdenum in a weight percent, to obtain a $R_c$ hardness of at least 47, after said article having been quenched and tempered, said $R_c$ hardness being measured in the middle of a section having a thickness of no more than 25.4 mm (1 in), of at least 50% of the hardness measured at the surface of said section; and the balance essentially iron.

5. A high toughness steel article, as set forth in claim 4, wherein said steel article, after having been quenched and tempered, has a $R_c$ hardness measured in the middle of a section having a thickness of no more than 25.4 mm (1 in), of at least 75% of the hardness measured at the surface of said section.

6. A high toughness steel article, as set forth in claim 4, wherein said steel article, after having been quenched and tempered, has a $R_c$ hardness measured in the middle of a section having a thickness of no more than 25.4 mm (1 in), of at least 90% of the hardness measured at the surface of said section.

7. A high toughness steel article, as set forth in claim 1, wherein said composition comprises, by weight percent:

from 0.26 to 0.41 carbon, from 0.00 to 0.03 aluminum, from 0.02 to 0.10 titanium, from 0.001 to 0.005 boron, from 0.01 to 0.1 niobium, from 0.017 to 0.027 nitrogen, from 0.0015 to 0.0035 oxygen, less than 0.018 phosphorous, less than 0.015 sulfur;

effective amounts of manganese, silicon, nickel, chromium, vanadium, and molybdenum in a weight percent, to obtain a $R_c$ hardness, after said article having been quenched and tempered, said $R_c$ hardness of at least 47 being measured in the middle of a section having a thickness of no more than 25.4 mm (1 in), of at least 50% of the hardness measured at the surface of said section; and the balance essentially iron.

8. A high toughness steel article, as set forth in claim 7, wherein said steel article, after having been quenched and tempered, has a $R_c$ hardness measured in the middle of a section having a thickness of no more than 25.4 mm (1 in), of at least 75% of the hardness measured at the surface of said section.

9. A high toughness steel article, as set forth in claim 7, wherein said steel article, after having been quenched and tempered, has a hardness measured in the middle of a section having a thickness of no more than 25.4 mm (1 in), of at least 90% of the hardness measured at the surface of said section.

10. A high toughness steel article having a composition comprising, by weight percent:

from 0.10 to 1.05 carbon, from 0.00 to 0.05 aluminum, from 0.01 to 0.20 titanium, from 0.0005 to 0.02 boron, from 0.01 to 0.20 niobium, less than 0.25 vanadium, from 0.015 to 0.04 nitrogen, from 0.001 to 0.004 oxygen, less than 0.025 phosphorous, less than 0.025 sulfur, from 0.30 to 1.75 manganese, from 0.10 to 1.45 silicon, from 0.0 to 3.50 nickel, no more than 0.25 vanadium, from 0.00 to 1.60 chromium, from 0.0 to 0.75 molybdenum, and the balance essentially iron;

said steel article, after having been quenched and tempered, having a $R_c$ hardness measured in the middle of a section having a thickness of no more than 25.4 mm (1 in), of at least 50% of said hardness measured at the surface of said section;

said steel article further having only trace amounts of aluminum nitride; and said steel article, after having been quenched and tempered, further having a plane strain fracture toughness more than 25% higher than that for steel having the same base chemistry and heat treatment, and being free from titanium, niobium, and boron and elevated nitrogen.

* * * * *

UNITED STATES PATENT AND TRADEMARK OFFICE

CERTIFICATE OF CORRECTION

PATENT NO. : 5,525,167

DATED : June 11, 1996

INVENTOR(S) : McVicker et al.

It is certified that error appears in the above-identified patent and that said Letters Patent is hereby corrected as shown below:

The title page item [75],
ONE OF THE INVENTORS' NAMES WAS OMITTED ON THE TITLE PAGE.

IT SHOULD READ AS FOLLOWS:

Inventor: Joseph E. McVicker, Chillicothe; Kenneth W. Burris, Peoria, both of Illinois.

Signed and Sealed this

Seventeenth Day of September, 1996

*Attest:*

*Attesting Officer*

BRUCE LEHMAN

*Commissioner of Patents and Trademarks*